US006669336B1

(12) United States Patent
Kneezel et al.

(10) Patent No.: US 6,669,336 B1
(45) Date of Patent: Dec. 30, 2003

(54) INK JET PRINTHEAD HAVING AN INTEGRAL INTERNAL FILTER

(75) Inventors: Gary A. Kneezel, Webster, NY (US); Andrew S. Yeh, Rochester, NY (US); Steven J. Dietl, Ontario, NY (US); Darron D. Lockett, Florence, SC (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/209,474

(22) Filed: Jul. 30, 2002

(51) Int. Cl.[7] ..... B41J 2/175; B41J 2/05
(52) U.S. Cl. ..... 347/93; 347/65
(58) Field of Search ..... 347/63, 65, 93

(56) References Cited

U.S. PATENT DOCUMENTS

| | | | | |
|---|---|---|---|---|
| 4,639,748 A | | 1/1987 | Drake et al. | |
| 4,864,329 A | | 9/1989 | Kneezel et al. | |
| 5,124,717 A | | 6/1992 | Campanelli et al. | |
| 5,132,707 A | * | 7/1992 | O'Neill | 347/65 |
| 5,141,596 A | | 8/1992 | Hawkins et al. | |
| 5,204,690 A | | 4/1993 | Lorenze, Jr. et al. | |
| 5,463,413 A | | 10/1995 | Ho et al. | |
| 5,665,249 A | | 9/1997 | Burke et al. | |
| 5,716,533 A | | 2/1998 | O'Neill et al. | |
| 6,139,674 A | | 10/2000 | Markham et al. | |
| 6,254,222 B1 | * | 7/2001 | Murata et al. | 347/65 |
| 6,286,941 B1 | | 9/2001 | Courian et al. | |
| 6,309,054 B1 | | 10/2001 | Kawamura et al. | |
| 2003/0048333 A1 | * | 3/2003 | Rapp et al. | 347/65 |

* cited by examiner

*Primary Examiner*—Michael S Brooke
(74) *Attorney, Agent, or Firm*—Robert A. Chittum

(57) ABSTRACT

An ink jet printhead has an upper substrate containing a reservoir with ink inlet and a lower substrate having a linear array of droplet generating elements and addressing electrodes thereon. At least two layers of polymeric material are serially deposited and patterned over the droplet generating elements and addressing electrodes prior to mating the two substrates. The patterned polymeric layers define an elongated opening containing an array of posts therein and a plurality of channels, each channel containing a droplet generating element. One end of the channels is open to serve as nozzles and the other end is in communication with the elongated opening with the array of posts. After the two substrates are aligned and mated, the reservoir is in communication with the elongated opening, so that the ink from the reservoir is filtered prior to entering the channels by passing between and over the posts in the elongated opening.

11 Claims, 5 Drawing Sheets

INK JET PRINTHEAD HAVING AN INTEGRAL INTERNAL FILTER

BACKGROUND OF THE INVENTION

The present invention relates to ink jet printheads that have integral internal ink filters, and, more particularly, to thermal ink jet printheads that have filter structures that are fabricated inside the printheads using polymeric layers generally used for other purposes. More broadly, it applies to the formation of internal filtration structures for micro-fluidic devices, where the filtration occurs at a gap intentionally formed between features on two substrates when those two substrates are bonded together.

Thermal ink jet printing systems use thermal energy pulses generated by the heating elements in an ink jet printhead to produce momentary ink vapor bubbles on the heating elements which eject ink droplets from the printhead nozzles. One type of such a printhead has a plurality of parallel ink channels, each communicating at one end with an ink reservoir and having opposing open ends that serve as nozzles in the droplet emitting face of the printhead. A heating element, usually a resistor, is located in each of the ink channels a predetermined distance upstream from the nozzle openings. The heating elements are individually driven with current pulses to momentarily vaporize the ink and form a bubble that forms a pressure wave which expels a droplet of ink. The channel is then refilled by capillary action, drawing ink from a supply tank. A meniscus is formed at each nozzle under a slight negative pressure to prevent ink from weeping therefrom. Operation of a thermal ink jet printer is described, for example, in U.S. Pat. Nos. 4,849,774 and 4,571,599.

The carriage type ink jet printer typically has one or more printheads containing the ink channels which open into a shared nozzle face. The printheads are connected to an ink supply tank. In one configuration, the printhead and one or more ink tanks are integrally assembled and the entire configuration, sometimes referred to as a cartridge, is disposable when the ink in the ink tanks are depleted. In another configuration, the printhead is an integral part of a replaceable ink tank support and replaceable ink supply tanks are installed on the ink tank support. Each of the ink supply tanks is replaced when the ink contained therein is depleted. The replaceable ink tank support should not need to be replaced until several (e.g., ten) ink supply tanks have been emptied during printing operations. In yet another configuration, ink tanks on the carriage are periodically refilled, when needed, from an off-carriage ink supply.

Whether the carriage type ink jet printer uses replaceable cartridges comprising integral printheads and ink supply tanks, or replaceable ink tank supports with integral printheads and separate replaceable ink tanks, or refillable tanks, the printheads are translated in a printing zone in one direction to print a swath of information on a recording medium, such as paper. The swath height is equal to the length of the column of nozzles in the printhead's nozzle face. The paper is held stationary during the printing and, after the swath is printed, the paper is stepped a distance equal to the height of the printed swath or a portion thereof. This procedure is repeated until the entire page is printed or until all information has been printed, if less than a page. For an example of a typical ink cartridge, refer to U.S. Pat. No. 5,519,425 which discloses disposable ink cartridges having integral printheads and ink supply tanks, and refer to U.S. Pat. No. 5,971,531 for a replaceable ink tank support having integral printheads and separately replaceable ink supply tanks.

In yet a further configuration of a thermal ink jet printer, the printer has printheads configured as a page-width array. In this case, the printheads do not move back and forth to form the printed image, but remain stationary and the recording medium, such as paper, is moved at a constant velocity past the page-width printheads. Whether carriage type or page-width printhead array type printer, one cause of unreliability is clogging of printhead channels with particles.

As is well known, particles in the ink can enter the relatively large printhead inlets and plug one or more channels, so that such channels do not eject ink droplets or eject droplets erratically. In order to print with small droplets that are required for high-resolution printing, ink jet printheads necessarily have small fluidic passageways or channels. The smaller the passageways or channels the more readily they are plugged with particulate contamination usually present in all ink supplies. A variety of printhead filters have been used or proposed to solve the problem of particulate matter in the ink. However, all of them have shortcomings ranging from reduced printhead yield during fabrication to early printhead failure due to contaminants found in the volume between filter and channels.

In many existing thermal ink jet printers, filters have been used to remove particulate matter in the ink. Some printers use filters at the ink exit from ink supply cartridges while others have filters bonded over the printhead inlets. For example, in U.S. Pat. Nos. 4,864,329 and 6,139,674, a wafer-sized filter is laminated to the side of the aligned and bonded silicon wafers containing a plurality of printheads that have the printhead inlets. The individual printheads are obtained by a sectioning operation that cuts through the two bonded wafers and the filter. The filter may be a woven mesh screen or electroformed screen or laser ablated film having a predetermined pore size. Since the filter covers one entire side of the printhead, the relatively large contact area prevents delamination of the filter.

U.S. Pat. No. 4,639,748 discloses an ink jet printhead having an internal filter. The printhead is composed of two parts that are aligned and bonded together. A surface of one part contains a linear array of heating elements and addressing electrodes, and a surface of the other part contains a set of etched recesses. The set of etched recesses include a parallel array of elongated recesses for use as capillary-filled ink channels having droplet emitting nozzles at one end. The other end is interconnected to a common reservoir recess. The reservoir recess has an internal wall defining a central chamber with an inlet. Small passageways are etched in the upper surface of the internal wall to permit the passage of ink from the chamber to the other side of the internal wall that is in communication with the channels. When the parts are mated, the top of the internal wall contacts the surface part having the heating elements, and the small passageways in the internal wall permit ink to flow therethrough. Each passageway has a smaller cross-sectional flow area than the nozzles to filter the ink, while the total cross-sectional flow areas of the passageways is larger than the total cross-sectional area of nozzles.

U.S. Pat. No. 5,716,533 discloses a method of fabricating ink jet printheads from channel plates and heater plates that have a filter in the printhead inlets. The channel plates are obtained from p-type silicon waters, one surface of which has a doped n-type patterned layer in the form of a screen. A first etch resistant material is deposited on both surfaces of the wafer and patterned on the surface opposite the one containing the n-type layer. The patterned first etch resistant material provides a first etch mask with channel and reservoir vias. A second etch resistant material is deposited over the first etch resistant material and patterned on the same wafer surface as the first etch resistant material, in order to provide a second etch mask having reservoir vias smaller than the vias in the first etch mask, but aligned therewith. The wafer with the two patterned etch masks is anisotropically etched with a bias potential between the p-n junction formed by the patterned n-type layer and the p-type wafer. The patterned n-type layer functions as an etch stop when under a bias potential. When the reservoir recesses have been etched through the wafer, the screen patterned n-type layer is left covering the open bottom of the reservoir that serves as an ink inlet. The second etch resistant material is removed and the wafer is anisotropically etched again to etch the channel recesses and complete the reservoir recesses with a similar bias potential. The first etch resistant material is removed and the etched wafer is aligned and bonded to a heater wafer. The bonded pair of wafers is separated into a plurality of printheads having an integral inlet filter.

U.S. Pat. No. 5,204,690 discloses an ink jet printhead that has an integral filter over the ink inlet of the printhead. The filter is produced by orientation dependent etching during printhead fabrication. A silicon channel wafer is etched from one side to produce the reservoir recesses and associated ink channels. The reservoir recesses are produced by a time controlled etch process, so that each reservoir recess has a predetermined depth in the channel wafer. The channel wafer is etched from the other side to produce a pattern of filter pores in alignment with the bottoms of the reservoir recesses. Thus, integral filters are provided, but the time-dependent orientation dependent etching adds complexity and the necessity of separate photolithography steps to etch the filter pores adds extra costs.

U.S. Pat. No. 5,124,717 discloses an ink jet printhead having an integral membrane filter fabricated over the surface of the printhead containing the ink inlet to the printhead reservoir. The integral membrane filter is formed out of one or more etch resistant masks by patterning filter pore vias therethrough that are in alignment with the open etched-through bottom of the printhead reservoirs. In one embodiment and for added strength, the side of the channel wafer which is not exposed to the etchant to produce the channels and reservoirs is heavily doped to form an etch stop which prevents the reservoir recess from being etched through the channel wafer. This heavily doped region between the pattern of filter pore vias in the etch resistant mask (membrane filter) and the bottom of the reservoir recess is etched using the membrane filter as a mask to open the filter pores through the heavily doped region of the channel wafer. The etched pores in the doped region are in alignment with the vias in the membrane filter and therefore increase the filter thickness and its overall strength.

U.S. Pat. No. 5,141,596 discloses an ink jet printhead having an integral filter over the ink inlet of the printhead reservoir. The surface of the channel wafer opposite the one etched to provide the channels and reservoirs is doped in a screen pattern to produce an etch stop layer in a screen pattern. The through etch of the reservoir recess exposes the patterned etch stop at the bottom of each reservoir recess, but only the undoped regions are etched through, thereby providing an integral filter at the ink inlet.

U.S. Pat. No. 5,463,413 discloses the use of pillars concurrently patterned in a photopolymer layer that defines the ink flow paths between the ink inlet and the heating elements or resistors in a roof shooter type printhead. The pillars are located in the ink flow path and provide the dual function of support for a nozzle plate and prevention of contaminants carried by the ink from reaching the narrower ink channels that funnel ink to the heating elements and/or the nozzles in the nozzle plate. The pillars are centered on and upstream from the heating elements. The spacing between pillars provides the required filtering, and all ink must flow between the pillars, since they have the same height as the thickness of the photopolymer layer into which the ink flow paths have been patterned. However, the pillars can be knocked off during the fabricating process, thus becoming useless or even becoming a contaminant themselves.

U.S. Pat. No. 6,286,941 discloses a roof shooter type ink jet printhead comprising a silicon substrate containing the heating elements, an overlying barrier layer of photopolymer material patterned to expose the heating elements and to provide the ink flow paths, and a tape adhered to the patterned barrier layer that contains nozzles aligned over the heating elements. The tape also contains a plurality of grooves for each heating element that provides for the passage of ink from the ink reservoir to the flow paths in the barrier layer. The grooves in the tape have cross-sectional areas smaller than the nozzles or other narrow points in the ink flow paths in the barrier layer, so that the grooves prevent entry of contaminants that could clog the printhead.

U.S. Pat. No. 6,309,054 discloses a roof shooter type ink jet printhead having a firing chamber with heating elements or resistors on the floor thereof and a nozzle plate with nozzles therein which are aligned over the heating elements. Current pulses selectively applied to the heating elements cause the ejection of ink droplets through the nozzles in a direction perpendicular to the heating elements. Ink inlets are provided in the floor of the firing chamber and provide the passageways for the ink to enter the firing chambers from an ink feed channel located below the firing chambers. Pillars are formed that extend from the outer surface of the firing chamber floor and into the ink feed channel. The pillars substantially surround the ink inlets in the firing chamber floor, thus preventing contaminants in the ink from blocking the ink inlets to the firing chambers or entering the firing chambers. The pillars extend in a direction substantially opposite to the flow direction of the ink through the ink inlets.

SUMMARY OF THE INVENTION

It is an object of the present invention to provide an improved ink jet printhead having an integral internal filter that is fabricated inside the printhead adjacent the entrances to the ink channels that contain the heating elements and droplet ejecting nozzles.

It is another object of the invention to form the internal integral filter between two substrates, such that the filtration action occurs at one or more gaps which are intentionally formed between features on the two substrates when the substrates are bonded together.

It is another object of the invention to form the filter inside the printhead from one or more layers of polymer, such that height of the filter is less than the combined thickness of the polymer layers.

In one aspect of the present invention, there is provided an ink jet printhead having an integral internal filter, comprising: an upper substrate having an ink inlet for a fluid; a lower substrate having an array of droplet generating elements and addressing electrodes on one surface thereof; at least two patternable layers being patterned on said one surface of the lower substrate to form an array of fluidic passageways therein and a recess with an array of posts therein, the posts having a predetermined height and spacing, each passageway containing a respective one of the droplet generating elements and having at least one end, said at least one end of each passageway being in communication with the recess to allow fluid to flow to the droplet generating elements; and said upper substrate being aligned and bonded to an upper surface of the patterned layers, so that the inlet is in communication with the recess, and the posts in said recess serve as a fluid filter located between the inlet and the passageways.

In another aspect of the invention, there is provided an ink jet printhead having an integral internal filter, comprising: an upper substrate having a reservoir hole etched therethrough from one surface thereof; a lower substrate having a linear array of heating elements and addressing elements patterned on one surface thereof, said addressing elements having a set of contact pads along an edge of said one surface of the lower substrate; a first layer of polymeric material being deposited on said one surface of the lower substrate and over the heating elements, addressing electrodes, and contact pads, the first layer of polymeric material being patterned to expose each individual heating element and said contact pads and to form an array of polymeric posts in an elongated opening exposing said one surface of the lower substrate, the array of posts in the elongated opening being substantially parallel to said linear array of heating elements, each of the posts being spaced from an adjacent post by a predetermined distance; a second layer of polymeric material being deposited over said one surface of the lower substrate and over the patterned first layer of polymeric material, the second layer of polymeric material being patterned to remove the second layer of polymeric material from the elongated opening, array of posts therein, and the contact pads and to form a parallel set of channels having opposing ends that are perpendicular to said elongated opening containing the array of posts, there being one channel for each heating element, each channel being aligned with and containing therein a respective one of the heating elements, one end of each channel being in communication with the elongated opening and the other end of each channel being open; and said one surface of the upper substrate being aligned and bonded to said second layer of polymeric material on the lower substrate, so that the reservoir hole in the upper substrate is in communication with the elongated opening in the first and second layer of polymeric material.

In one embodiment of the invention, the array of posts in the elongated openings are cylindrically shaped and the integral internal filter is achieved by the ink passing both between the posts and over the top of the posts. In other embodiments, the shapes of the posts are diamond shapes in cross-sectional area or solid fences with the filtering being provided by the clearance between the upper surface of the fence and the confronting surface of the upper substrate.

BRIEF DESCRIPTION OF THE DRAWINGS

The present invention will now be described, by way of example, with reference to the accompanying drawings, in which like reference numerals refer to like elements, and in which.

DESCRIPTION OF THE PREFERRED EMBODIMENT

Figure 1:
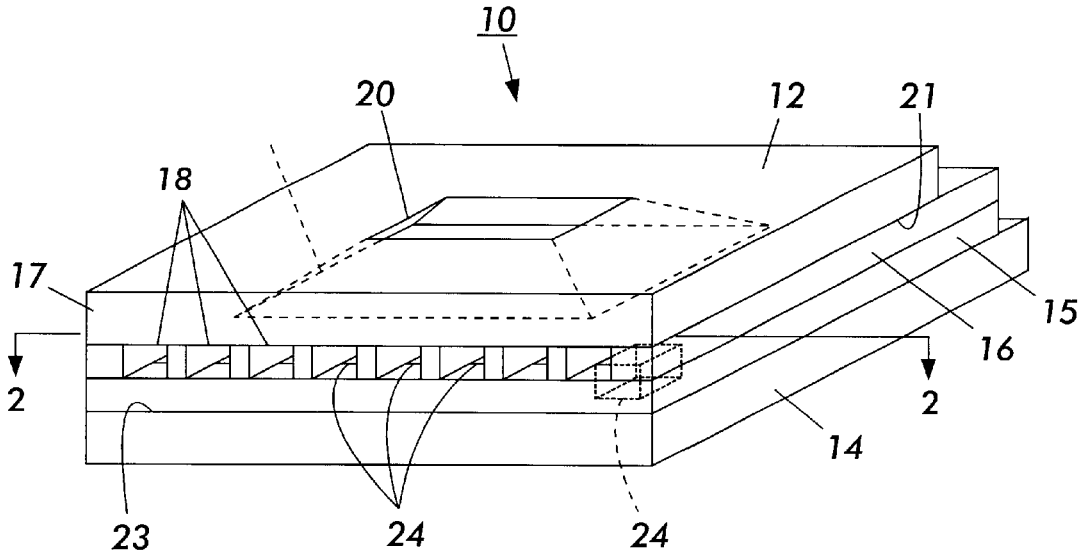
FIG. 1 is an isometric view of the ink jet printhead of the present invention, showing the front face of the printhead having the nozzles.
Figure 2:
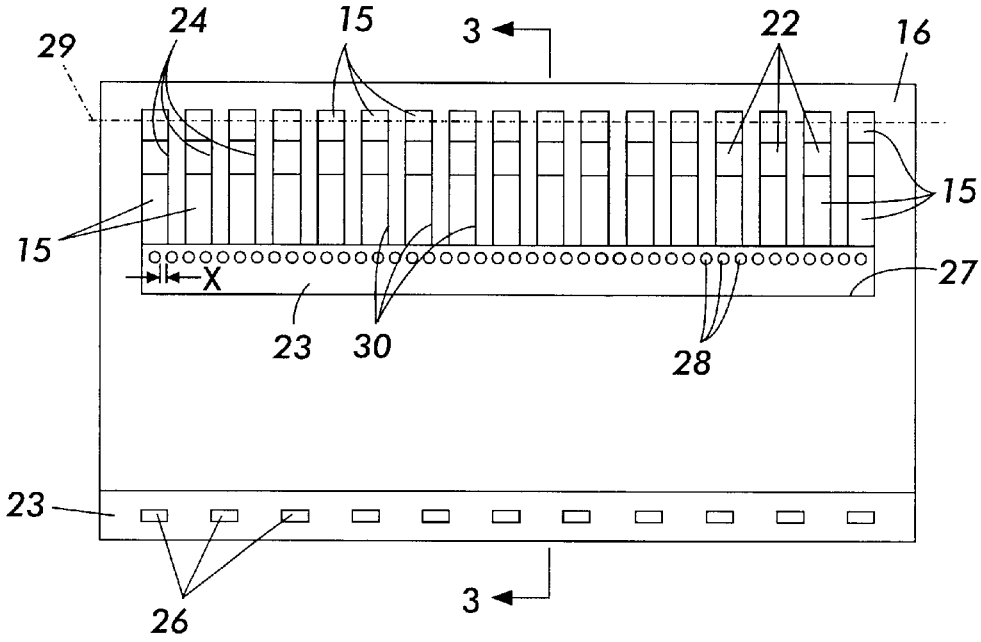
FIG. 2 is a plan view of the printhead taken along the view line 2—2 in FIG. 1.
Figure 3:
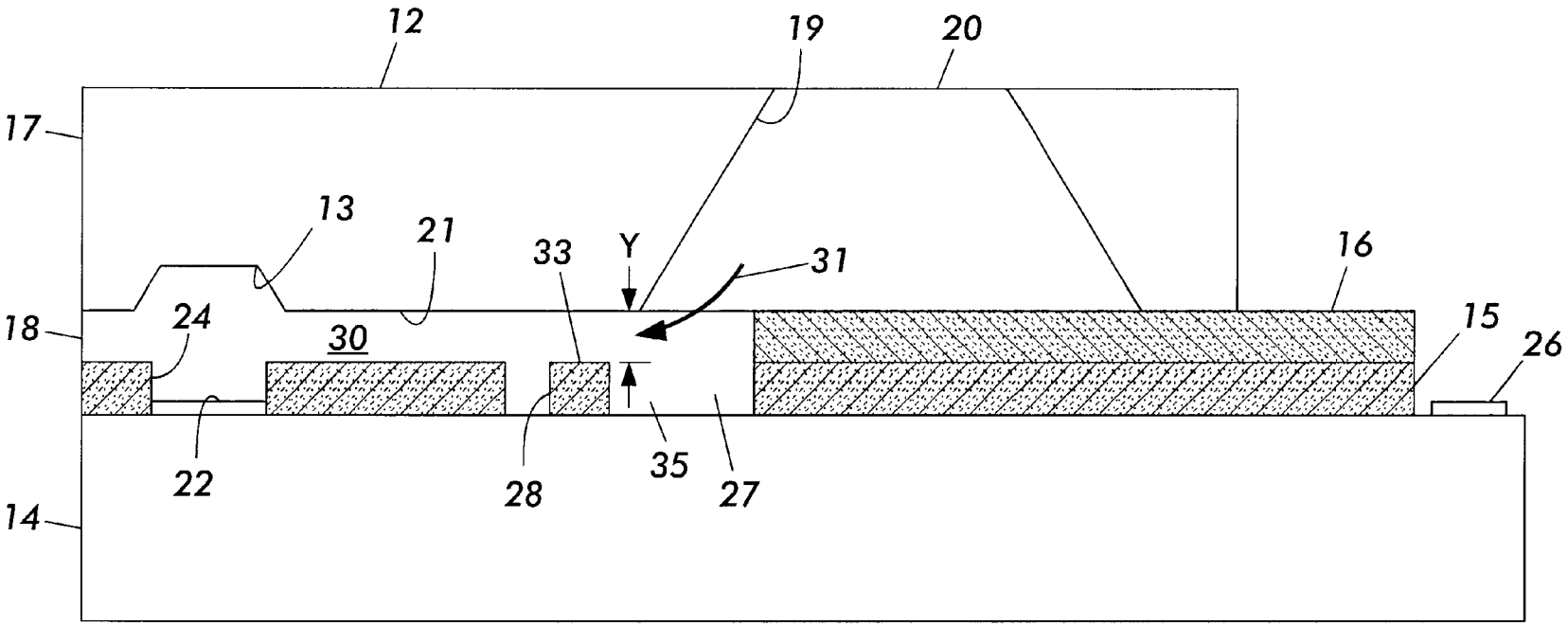
FIG. 3 is a sectional view of the printhead as viewed along view line 3—3 in FIG. 2.

In FIG. 1, a thermal ink jet printhead 10 of the present invention is shown comprising an upper substrate or channel plate 12 and lower substrate or heater plate 14 with at least two separately deposited and patterned layers 15,16 of polymeric material sandwiched therebetween. In this isometric view of the printhead 10, the front face 17 of the printhead is shown with the array of droplet emitting nozzles 18 therein. In the preferred embodiment, the upper substrate is a portion of a silicon (100) wafer (not shown) having an orientation dependent etched recess 19 (shown in dashed line) that is etched through the upper substrate from surface 21 thereof and serves as the printhead ink reservoir. The open bottom 20 of the etched through recess 19 serves as the ink inlet. Referring also to FIGS. 2 and 3, the upper substrate has an array of relatively small recesses 13, one for each droplet generating element or heating element 22. Each of the small recesses 13 is aligned directly over a respective one of the droplet generating or heating elements and is used for bubble expansion during the printing process. The lower substrate 14 has a linear array of heating elements or droplet generating elements 22, sometimes referred to as transducers, formed on one surface 23 thereof, together with addressing electrodes (not shown). The heating elements are generally resistors and the droplet generating elements may be, for example, piezoelectric devices. As discussed later, polymeric layer 15 is deposited on surface 23 of the lower substrate 14 and over the heating elements and addressing electrodes. The polymeric layer 15 is then patterned to remove the polymeric layer 15 from each heating element, thus placing each heating element in pits 24, one pit 24 being fully shown in dashed line. The use of a polymeric layer, sometimes referred to as a thick film layer, to place heating elements in pits is well known, such as disclosed in U.S. Pat. Nos. 4,774,530 and 5,141,556, the relevant parts of which are incorporated herein by reference. In addition to forming the pits 24 to expose the heating elements or droplet generating elements, the contact pads 26 for the addressing electrodes are cleared of the polymeric layer and an elongated recess 27 is formed. Concurrently, an array of posts 28 is formed in the elongated recess 27 from the polymeric layer 15.

FIG. 2 is a plan view of the printhead 10 as viewed along view line 2—2 in FIG. 1. In this view, the upper substrate 12 has been omitted to show the patterned polymeric layers 15,16. Though the lower substrate or heater plate 14 may be an electrically insulative material, such as, for example, glass or a ceramic material, the lower substrate is preferably a portion of a silicon wafer (not shown). Forming a plurality of sets of heating elements or droplet generating elements and associated addressing electrodes for each set of heating elements on the polished surface of a silicon wafer are well known in the ink jet industry, as disclosed in U.S. Pat. Nos.

4,994,826 and 4,532,530, and will, therefore, not be discussed in further detail.

A polymeric layer 15, such as polyimide or SU-8®, is deposited on a silicon wafer (not shown) and over the sets of linear arrays of heating elements and addressing electrodes. The addressing electrodes include contact pads for connection to an external source of electrical signals. The portion of the silicon wafer containing one linear array of heating elements and addressing electrodes is the lower substrate 14. Hereafter, the invention will be discussed in terms of the lower substrate 14 rather than in terms of a wafer that contains many lower substrates. Polymeric layer 15 is patterned by means well known in the industry to remove the polymeric layer from each of the heating elements and contact pads and to form an elongated recess 27 which exposes the surface 23 of the lower substrate. Concurrently, an array of posts 28 of polymeric layer 15 is formed in the elongated recess 27. Each post 28 is spaced from adjacent posts by a predetermined distance X, usually about 10 $\mu$m. More generally, X is chosen to be small enough such that particles which can pass between adjacent posts can also flow through the channel 30 and be ejected with the ink droplet. As will be better understood later, the posts serve as the integral internal filter for the printhead 10. The elongated recesses 27 are spaced from but substantially parallel to the heating element array.

Though the printhead 10 of this invention is described with only two polymeric layers 15,16 for sake of clarity, N layers of polymeric material could be used with N being at least two. However, the one essential feature required is that the posts 28 be less in height than the combined thickness of the N layers of polymeric material. The integral internal filter of printhead 10 is thus provided inside the printhead by the posts 28 in the elongated recess 27, which posts are produced from one or more layers of polymeric material. The ink or fluid, when the embodiment is a generic microfluidic device, is filtered as the ink passes between the posts in the elongated recess as well as by the spacing between the tops 33 of the posts and the upper substrate 12, as will be described later.

After polymeric layer 15 has been patterned, polymeric layer 16 is deposited over the surface 23 of the lower substrate 14 and over the patterned polymeric layer 15. Polymeric layer 16 is patterned to remove the polymeric layer 16 from the contact pads, elongated recess 27, and array of posts 28 in the elongated recess. In addition, a parallel set of channel recesses 30 having opposing ends is formed that is substantially perpendicular to the elongated recess. One channel recess is provided for each heating element, and each channel recess is aligned with and contains therein a respective one of the heating elements in pit 24. One end of the channel recess is adjacent and interconnected with the elongated recess, while the other channel recess end is open. Dashed line 29 indicates a dicing line that forms the front face 17 of the printhead and opens the channel recess ends, which will subsequently serve as the nozzles 18.

FIG. 3 is a cross-sectional view of printhead 10 as viewed along view line 3—3 in FIG. 2. The upper substrate 12 is aligned and bonded to the patterned polymeric layer 16, after the top surface thereof has been polished by a chemical and mechanical process, such as that disclosed in U.S. Pat. No. 5,665,249 and incorporated herein by reference. The front face 17 is formed by a dicing operation that opens one end of the channel recesses 30. In this embodiment, where only two polymeric layers are used, the thickness of polymeric layer 16 is about the distance equal to the spacing X (see FIG. 2) between the posts, or the post height must be such as to provide a distance Y from the top of the posts to the surface 21 of the upper substrate, where Y is 1 to 20 $\mu$m, and in the preferred embodiment about 10 $\mu$m. In order for the posts to filter the ink traveling from the reservoir 19, as indicated by arrow 31, it is desired to provide an open space 35 in the front of the posts 28. Such an arrangement allows particles in the ink to be caught between the posts or caught above the posts and still provide enough space for the ink to flow past the other posts and into the channel recesses 30.

There are at least two advantages of having the filtering posts shorter than the upper surface of the polymeric layer 16. First, a filter formed from a shorter post allows greater ink flow. Particles in the ink will be trapped as long as the difference in height between the posts and the top surface of the polymeric layer 16 is smaller than the size of the particles which are desired to be trapped and therefore filtered out. In general, it is not necessary to catch all particles, only those particles which are large enough to be caught and trapped in the channels and not washed out when ink droplets are ejected from the nozzles. The second advantage of this internal filter configuration is that the top surface of polymeric layer 16 can be polished by a chemical/mechanical process without damaging the shorter posts. Polishing the upper surface of the polymeric layer 16 enables a flat surface which can be bonded to the upper substrate 12 without gaps. In typical chemical/mechanical polishing processes, any free standing posts not shorter in height than the combined thickness of the polymeric layers would be frequently dislodged. This not only causes a filter defect in the printhead, but also any chunks of polymeric material dislodged are forced into other delicate structures, such as the channel walls, in the same or other printheads and cause poor yield due to the damage. By having the heights of the filter posts less than the combined height of the polymeric layers, the posts are not exposed to the forces of the chemical/mechanical polishing operation when the top surface of the polymeric layer 16 is polished.

Figure 5:
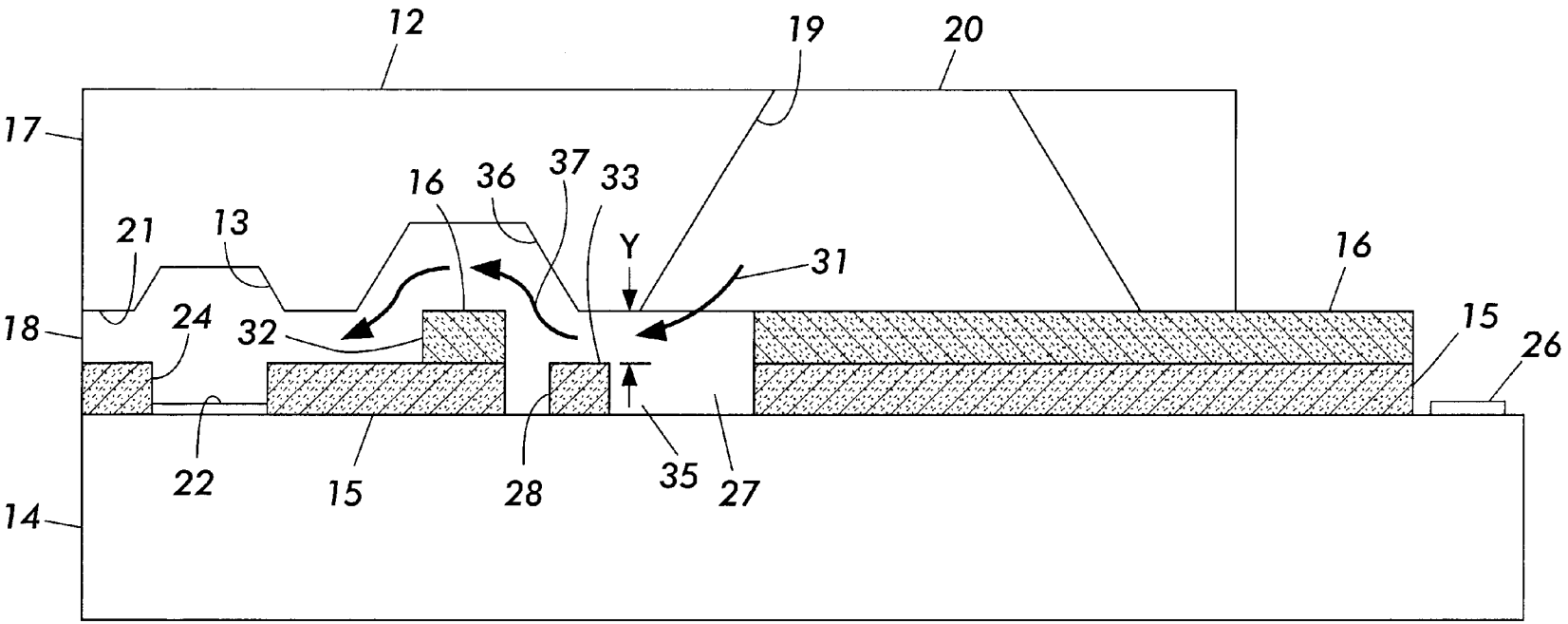
FIG. 5 is a cross-sectional view similar to FIG. 3, showing an alternate embodiment of the invention as viewed along view line 5—5 in FIG. 4.

In some cases, it may be desired to polish both polymeric layers 15,16, so that the surface of the first polymeric layer 15 is smooth and flat in front of the heating elements and adjacent the nozzles. In this case, the elongated recess 27 would be patterned without the posts 28. The patterned polymeric layer 15 having an open elongated recess without the posts can be safely polished. Then when the second polymeric layer 16 is deposited, the posts 28 are patterned in the elongated recess 27 from the polymeric layer 16. Thus, the posts 28 would be shorter than the combined thickness of the two layers. The second polymeric layer 16 is polished without damaging the posts, because they are shorter than the height of the top surface of the second polymeric layer 16. The thickness of the polymeric layers 15,16 is determined to provide the desired channel flow area and the desired height of the posts 28 in the elongated recess 27. As shown in FIGS. 3 and 5, the distance Y between the top 33 of the posts 28 and the upper substrate surface 21 is determined to be that required to filter unwanted contaminants that cannot be ejected with the ink droplets. The spacing X between posts 28 is usually about the same as distance Y, for example, about 10 $\mu$m. However, this is not a requirement.

Figure 4:
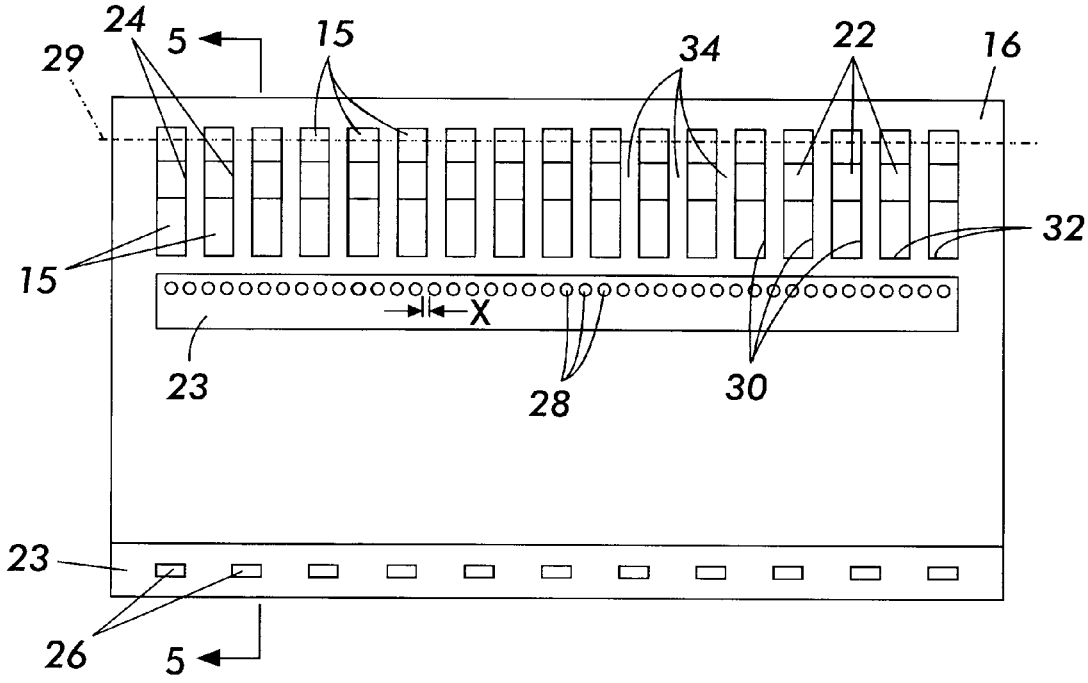
FIG. 4 is a view similar to FIG. 2 showing an alternate embodiment of the invention.

FIGS. 4 and 5 depict an alternate embodiment of the invention. FIG. 4 is a plan view similar to FIG. 2, and FIG. 5 is a cross-sectional view similar to FIG. 3 as viewed along view line 5—5 in FIG. 4. The difference between FIG. 4 and FIG. 2 is that the channel recess ends which are adjacent the elongated recess 27 in FIG. 4 have closed ends 32, while in the embodiment of FIG. 2, the channel recess ends which are adjacent the elongated recess are open and in communication therewith. Tying the walls 34 which separate the channel recesses 30 together by closed ends 32 makes them more robust against the forces to which they are subjected by the chemical/mechanical polishing procedure. However, to get ink into the channel recesses 30 that have closed ends 34 adjacent the elongated recess 27 and still allow ink the ink to be filtered by the posts 28, bypass recesses 36 are etched into the surface 21 of the upper substrate 12 above each closed end 32. The bypass recesses 36 are etched at the same time as the bubble expansion recesses 13 are etched. Thus, a bypass recess 36 straddles each of the closed ends 32 of the channel recesses 30. This location of the bypass recesses 36 provides a portion of the surface 21 of the upper substrate 12 directly above the top surface 33 of the posts 28. As a result, the ink is filtered by passing both between and over the tops of the posts 28 and over the closed end 32 through the bypass recess as indicated by arrows 37.

Figure 6:
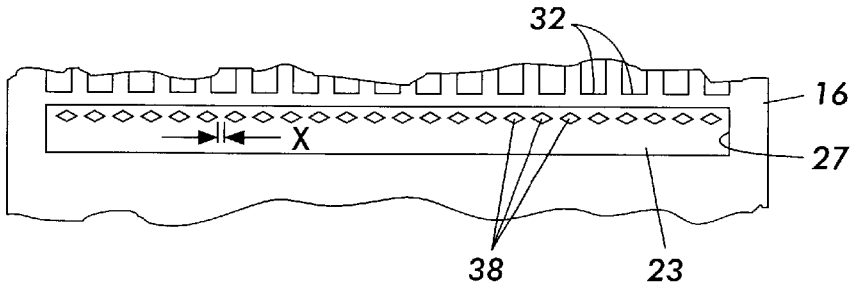
FIG. 6 is a partial plan view of the invention similar to FIG. 2, showing another embodiment.
Figure 7:
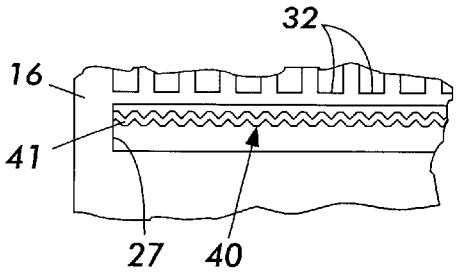
FIG. 7 is a partial plan view of the invention similar to FIG. 2, showing another embodiment.
Figure 8:
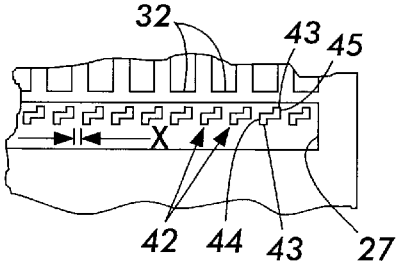
FIG. 8 is a partial plan view of the invention similar to FIG. 2, showing another embodiment.

The integral internal filter of the printhead 10 is shown as a single row of cylindrical posts, but several other configurations are possible. For example, multiple rows of posts (not shown) could be used instead of a single row of posts, with either the same or different spacing between the posts in the various rows. In FIG. 6, a partially shown plan view similar to FIG. 2, shows an alternate embodiment of the invention, wherein the cross-sectional shape of the posts 38 is a diamond shape with the predetermined spacing X between posts. In fact, the posts can be joined together to form a solid ridge or wall 40 having a height that is less than the combined total height of the polymeric layers 15, 16, such as that shown in FIG. 7, a partially shown plan view similar to FIG. 2. In FIG. 7, the solid ridge or wall 40 has a shape of a series of connected chevrons or V shapes, and in this embodiment, the particles in the ink get caught between the top 41 of the ridge 40 and surface 21 of the upper substrate 12. Another embodiment is shown in FIG. 8, a partially shown plan view similar to FIG. 2, wherein the cross-sectional shape of the posts 42 are rectangular with projections 43 extending from opposing ends 44,45 in opposite directions therefrom. The posts 42 in FIG. 8 appear to have a zigzag or flatten Z pattern with the predetermined spacing X between posts.

Although the foregoing description illustrates the preferred embodiment in thermal ink jet printheads, a type of micro-fluidic device, other variations are possible for micro-fluidic devices with an internal polymer filter. More generally, other variations are possible where the filter features over which the gap is formed between the two substrates is not a polymer, but any other is suitable material. Such integral internal filters and fluid flow passageways that are formed in patterned layers between the two substrates can be formed by additive processes, analogous to the patterning of polymer layers discussed above, for example, by electroforming or vacuum deposition. Alternatively, such filters and passageways may be formed by subtractive processes, such as by patterning of one or both substrates by chemical etching or reactive ion etching. All such variations as will be apparent to those skilled in the art are intended to be included within the scope of this invention as defined by the following claims.

What is claimed is:

1. An ink jet printhead having an integral internal filter, comprising;

an upper substrate having a reservoir containing an inlet for a fluid;

a lower substrate having an array of droplet generating elements and addressing electrodes on one surface thereof;

at least two patternable layers being serially deposited and patterned on said one surface of the lower substrate, said two patternable layers comprising a first and a second layer, said first layer having an upper surface and being patterned to form therein an elongated recess containing an array of posts and a plurality of pits, each of said posts in said array of posts having a predetermined equal spacing and having a top surface coplanar with said upper surface of said first layer, each of said pits being aligned with a respective one of the droplet generating elements to expose each of said droplet generating elements individually said second layer having a thickness substantially equal to the predetermined spacing between said posts and an upper surface, after said second layer being deposited on said upper surface of said patterned first layer, said second layer being patterned to remove said second layer from said elongated recess and array of posts therein and each of said pits formed in said first layer and to form an array of fluidic passageways therein, each of said passageways having opposing ends and having said upper surface of said first layer as a floor of each of said passageways, each passageway containing a respective one of said pits with a droplet generating element exposed therein, one end of each passageway being open for emitting said fluid and the other end being in communication with one side of said elongated recess to allow fluid to flow from said elongated recess through said passageways to said passageway open ends where said droplet generating elements cause fluid to be ejected therefrom; and said upper substrate being aligned and bonded to said upper surface of said second layer, so that the reservoir therein is in communication with a side of the elongated recess opposite the side in communication with the passageways, so that the fluid must flow past said array of posts in said elongated recess, whereby said array of posts serve as a fluidic filter located internally of said printhead and located between the reservoir and said passageways in said second layer.

2. The printhead as claimed in claim 1, wherein the fluid is ink;

wherein the droplet generating elements are heating elements;

wherein the array of fluidic passageways are an array of parallel channels, each channel having two opposing open ends, one end of each channel being open to serve as a droplet emitting nozzle and the other end being connected to said elongated recess containing said array of posts;

wherein said elongated recess is substantially perpendicular to the array of channels;

wherein the thickness of said first layer determines the height of each of the posts in said array of posts contained in said elongated recess, while the elongated recess has a depth equal to the combined thickness of said first and second layers; and wherein the thickness of said second layer is distance between the top surfaces of said posts and the upper substrate and is substantially equal to the predetermined spacing between said posts.

3. The printhead as claimed in claim 2, wherein the predetermined spacing of the posts in said array of posts are determined so as to prevent the passage therepast of any contaminants that cannot be ejected in an ink droplet from the printhead nozzles.

4. The printhead as claimed in claim 3, wherein said upper substrate has first and second opposing surfaces, said reservoir is a hole etched through said upper substrate from the first surface thereof and the interface of the hole with the second surface is said ink inlet;

wherein the upper substrate further comprises an array of recesses etched in said first surface of the upper substrate, each recess in said array of recesses being aligned over a one of the heating elements in said array of heating elements and is used for bubble expansion; and wherein the array of heating elements is formed in a linear array and the addressing electrodes have contact pads for connection to external electrical signals.

5. The printhead as claimed in claim 3, wherein the array of posts contained in said elongated recess is located therein to provide an open space upstream of said array of posts, so that particles caught by said posts do not impede the flow of ink through said posts.

6. The printhead as claimed in claim 5, wherein the first and second layers are polyimide;

wherein said parallel channels are perpendicular to said elongated recess; and wherein the upper surface of the patterned second layer is polished prior to aligning and bonding the upper substrate thereto.

7. The printhead as claimed in claim 5, wherein the cross-sectional shape of the posts in said elongated recess is circular.

8. The printhead as claimed in claim 5, wherein the cross-sectional shape of the posts in said elongated recess is diamond shaped.

9. The printhead as claimed in claim 5, wherein the cross-sectional shape of the posts in said elongated recess is rectangular with projections entending from opposing sides in opposite directions therefrom.

10. An ink jet printhead having an integral internal filter, comprising:

an upper substrate having a reservoir containing an inlet for a fluid;

a lower substrate having an array of droplet generating elements and addressing electrodes on one surface thereof;

at least two patternable layers being serially deposited and patterned on said one surface of the lower substrate, said two patternable layers comprising a first and a second layer, said first layer having an upper surface and being patterned to form therein an elongated recess and a plurality of pits, each of said pits being aligned with a respective one of the droplet generating elements to expose each of said droplet generating elements individually, said second layer having an upper surface and, after being deposited on said upper surface of said patterned first layer, said second layer being patterned to remove said second layer from said elongated recess and each of said pits formed in said first layer and to form both an array of posts in said elongated recess and an array of fluidic passageways therein, each of said passageways having opposing ends and having said upper surface of said first layer as a floor of each of said passageways in said second layer, each passageway containing a respective one of said pits with a droplet generating element exposed therein, one end of each passageway being open for emitting said fluid and the other end being in communication with one side of said elongated recess to allow fluid to flow from said elongated recess through said passageways to said passageway open ends where said droplet generating elements cause fluid to be ejected therefrom; and said upper substrate being aligned and bonded to said upper surface of said second layer, so that the reservoir therein is in communication with a side of the elongated recess opposite the side in communication with the passageways, so that the fluid must flow past said array of posts in said elongated recess, whereby said array of posts serve as a fluidic filter located internally of said printhead and located between the reservoir and said passageways in said second layer.

11. The printhead as claimed in claim 10, wherein the upper surface of the patterned first layer is polished prior to depositing and patterning of said second layer, since said array of posts have not yet been formed in said elongated recess and cannot be damaged by the polishing process.

* * * * *